US006205981B1

(12) United States Patent
Lorraine

(10) Patent No.: US 6,205,981 B1
(45) Date of Patent: Mar. 27, 2001

(54) FUEL RECIRCULATION FOR DIRECT INJECTION FUEL SYSTEM USING A HIGH PRESSURE VARIABLE VENTURI PUMP

(75) Inventor: Jack R. Lorraine, Newport News, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/339,279

(22) Filed: Jun. 23, 1999

Related U.S. Application Data

(60) Provisional application No. 60/125,886, filed on Mar. 24, 1999.

(51) Int. Cl.[7] ..... F02M 37/04
(52) U.S. Cl. ..... 123/514; 123/456
(58) Field of Search ..... 123/514, 456, 123/497

(56) References Cited

U.S. PATENT DOCUMENTS 5,133,324 * 7/1992 Michiaki ..... 123/514
5,139,000 * 8/1992 Sawert ..... 123/514
5,285,759 * 2/1994 Terada et al. ..... 123/514
5,832,900 * 11/1998 Lorraine ..... 123/456
5,983,869 * 11/1999 Cooke et al. ..... 123/514

* cited by examiner

*Primary Examiner*—Henry C. Yuen
*Assistant Examiner*—Arnold Castro

(57) ABSTRACT

A high pressure direct injection fuel system includes a low pressure fuel supply; a venturi pump including a variable orifice, first and second inlets and an outlet, the low pressure fuel supply connected to the first inlet of the venturi pump; a high pressure pump connected to the outlet of the venturi pump; a fuel rail connected to an outlet of the high pressure pump, the fuel rail including at least one fuel injector and a pressure sensor; a high pressure regulator connected to the fuel rail; a return flow line connected between the fuel rail and the second inlet of the venturi pump; and an electronic control unit connected to the pressure sensor and the high pressure regulator. The variable orifice venturi pump suppresses gas formation in the return fuel flow thereby allowing the use of a lower fuel supply pressure.

13 Claims, 4 Drawing Sheets

FUEL RECIRCULATION FOR DIRECT INJECTION FUEL SYSTEM USING A HIGH PRESSURE VARIABLE VENTURI PUMP

This application expressly claims the benefit of earlier filing date and right of priority from the following co-pending patent application: U.S. Provisional Application Serial No. 60/125,886 entitled "Fuel Recirculation For Direct Injection Fuel System Using A High Pressure Variable Venturi Pump" filed Mar. 24, 1999, cited patent application is expressly incorporated in its entirety by reference.

BACKGROUND OF THE INVENTION

The invention relates in general to fuel systems in internal combustion engines and in particular to high-pressure direct injection fuel systems.

The present invention is an improvement to the invention disclosed in U.S. Pat. No. 5,832,900 issued Nov. 10, 1998, entitled "Fuel Recirculation Arrangement and Method for Direct Fuel Injection Systems" and having the same inventor as the present application. The aforementioned U.S. patent is hereby expressly incorporated by reference.

Fuel injection systems have in recent years been equipped with injector valves which protrude from pressurized fuel rails, with fuel sprayed out of the injector valves when each is opened at timed intervals by the engine controls. The injectors typically have been arranged to spray the fuel into the intake manifold adjacent the intake valves of the engine cylinders such that the fuel in the fuel rail need only be pressurized to moderate levels, i.e., 3–4 bars.

In "direct injection" systems the injectors spray fuel directly into the engine cylinders. This requires a much higher fuel pressure, on the order of 20–140 bars at the injector tip. The fuel pressure is developed by a high-pressure pump. Fuel is supplied from the fuel tank to the inlet of the high-pressure pump by a conventional lower pressure supply pump.

As engine load varies, fuel demand is varied. To meet changing fuel demand, the pressure in the fuel rail is controlled by a regulator allowing a controlled outflow of fuel from the fuel rail to a lower pressure region. The high operating pressures in the fuel rail create the possibility that the fuel will be changed to a gaseous state when discharged by the regulator. Lighter dissolved components of the fuel, such as butane, methane, or even air, have a tendency to separate and form bubbles, which are very difficult to recombine with the liquid fuel. The presence of bubbles in the liquid fuel recirculated back to the high-pressure pump inlet could damage the high-pressure pump.

The work performed by the high pressure pump in raising the fuel to these high pressures also adds to the internal heat of the fuel, increasing the tendency for gaseous formation of bubbles to occur.

U.S. Pat. No. 5,832,900 (the '900 patent), referenced above, provides a fuel recirculation arrangement and method for minimizing the tendency for fuel to gasify in such high-pressure direct injection systems. In the '900 patent, the high-pressure return fuel flows through a fixed size orifice. The fixed size orifice limits the operating range of the recirculation system. At low flow rates of the high-pressure return fuel, most of the high-pressure pump output is being used by the flow to the injectors. Thus, at low flow rates of the high-pressure return fuel, it is difficult to maintain a minimum backpressure in the supply line to the high-pressure pump.

SUMMARY OF THE INVENTION

It is an object of the invention to increase the fuel pressure at the inlet of the high-pressure pump.

It is another object of the invention to reduce the energy required by the high-pressure pump to pressurize the fuel, thereby reducing the tendency for vaporization of the fuel.

It is a further object of the invention to provide a high-pressure venturi pump with a variable orifice to compensate for varying flow rates in the high-pressure return line.

It is still another object of the invention to provide a high-pressure venturi pump with a variable orifice to maintain a minimum backpressure in the supply line to the high-pressure pump.

These and other objects of the invention are achieved by a high pressure direct injection fuel system comprising a low pressure fuel supply; a venturi pump including a variable orifice, first and second inlets and an outlet, the low pressure fuel supply connected to the first inlet of the venturi pump; a high pressure pump connected to the outlet of the venturi pump; a fuel rail connected to an outlet of the high pressure pump, the fuel rail including at least one fuel injector and a pressure sensor; a high pressure regulator connected to the fuel rail; a return flow line connected between the fuel rail and the second inlet of the venturi pump; and an electronic control unit connected to the pressure sensor and the high pressure regulator.

The venturi pump comprises a housing defining a passageway therethrough for flow of return fuel, a chamber downstream of the passageway for mixing of the return fuel and low pressure supply fuel, and a spring loaded valve disposed in the passageway. The spring-loaded valve includes a downstream end having a diverging portion and a converging portion.

The variable orifice connects the passageway to the chamber and a size of the variable orifice is variable depending on the position of the downstream end of the spring-loaded valve.

Preferably, the first inlet of the venturi pump includes an annular region fluidly connected to the chamber downstream of the variable orifice.

In one embodiment, the downstream end of the passageway includes a converging section.

Another aspect of the present invention is a method of recirculating fuel in a high pressure direct injection system comprising controllably releasing high pressure fuel from a fuel rail into a venturi pump; varying the size of a variable orifice in the venturi pump depending on a pressure of the high pressure fuel released from the fuel rail; mixing the high pressure fuel with low pressure fuel to create an intermediate pressure fuel with a pressure between a pressure of the high pressure fuel and a pressure of the low pressure fuel; and supplying the intermediate pressure fuel to a high pressure pump.

The high-pressure fuel is controllably released from the fuel rail depending on the pressure sensed in the fuel rail.

In a preferred embodiment, the size of the variable orifice in the venturi pump is varied by movement of a spring-loaded valve having a downstream end with diverging and converging portions.

Further objects, features and advantages of the invention will become apparent from the following detailed description taken in conjunction with the following drawing.

DETAILED DESCRIPTION OF THE PREFERRED EMBODIMENT

Figure 1:
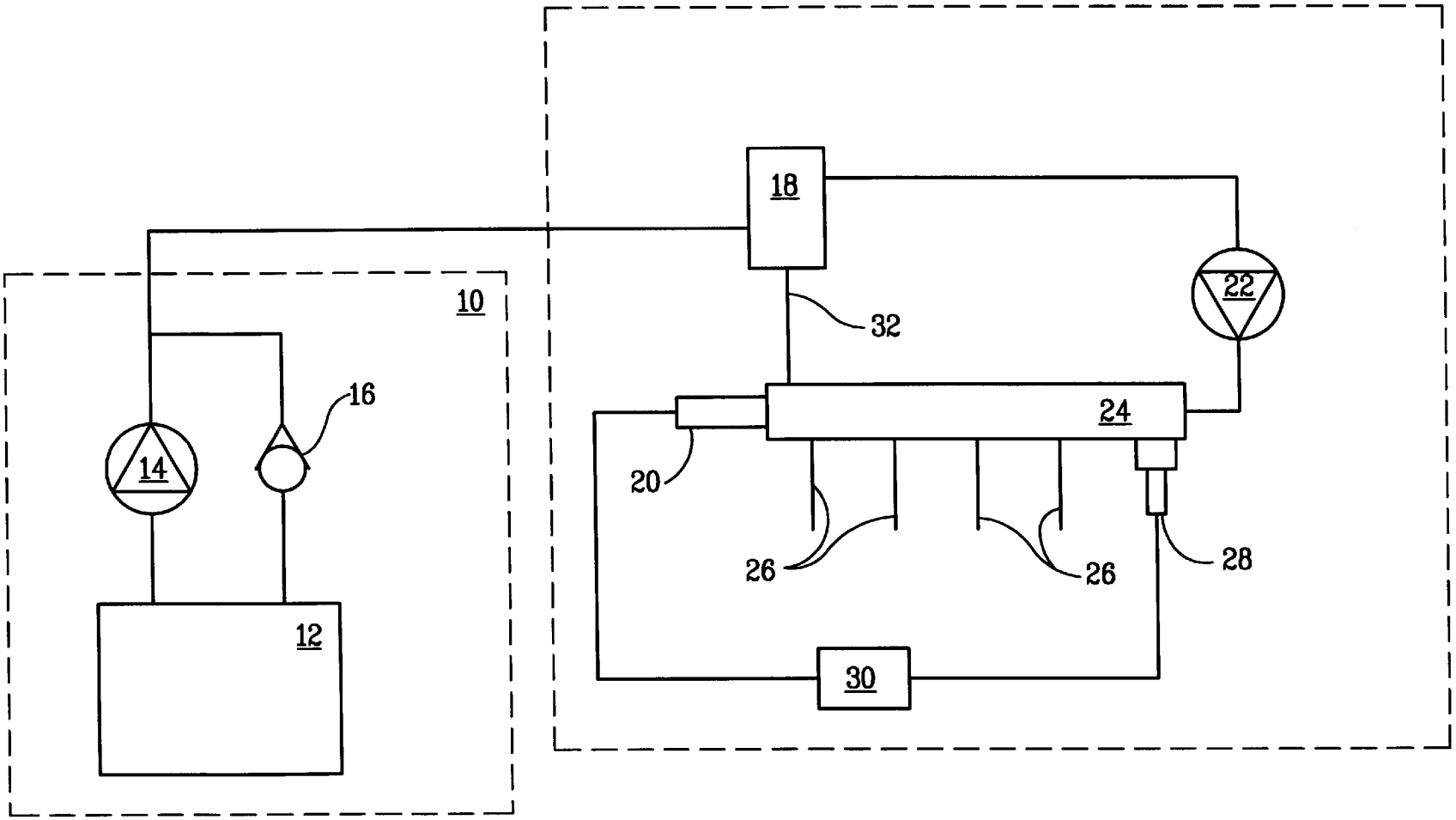
FIG. 1 schematically shows the general layout of the high-pressure direct injection system according to the invention.

Referring now to the FIGURES, FIG. 1 schematically shows the general layout of the high-pressure direct injection system according to the invention. The lowpressure fuel supply 10 includes a fuel tank 12, a pump 14 and a regulator 16. The low-pressure regulator 16 controls the delivery pressure of the low-pressure fuel supply 10. The low pressure fuel supply 10 delivers fuel to the venturi pump 18 where the low pressure fuel is combined with the return fuel flow 32 from the high pressure regulator 20. The combined fuel is then delivered to the inlet of the high-pressure pump 22. The high-pressure pump 22 pressurizes the combined fuel to operating pressure and delivers the fuel to the fuel rail 24.

The fuel rail 24 acts as a high-pressure reservoir from which the fuel injectors 26 allow fuel to flow to each cylinder (not shown). The pressure in the fuel rail 24 is sensed by a pressure sensor 28 that sends an electronic signal to the electronic control unit (ECU) 30. The ECU 30 determines whether or not the high-pressure regulator 20 needs to be opened or closed to increase or decrease the return flow 32 to the venturi pump 18.

The pressure in the fuel rail is in the range of 40 to 120 bar. The pressure in the low-pressure fuel supply is in the range of 3.5 to 4.5 bar. When fuel goes through the high-pressure regulator 20 from the fuel rail pressure to the low-pressure supply pressure, pressure energy within the fuel is released. The pressure energy can take the form of latent heat thereby transforming some of the fuel from a liquid to a gas. The fuel is a homogenized mixture including propane, butane and other small molecules (Light fluid compounds). The light compounds turn to gas first, collect in the form of bubbles and are resistant to reabsorption back into the fuel.

The bubbles create two problems for the high-pressure pump 22. First, the boundary layer of fluid between sliding surfaces is not available to minimize wear. Second, the initial charge (volume of liquid) to be pressurized is not adequate to meet the delivery requirement.

The venturi pump 18 uses some of the energy released from the fuel when it is reduced in pressure to increase the pressure of the supply fuel. Therefore, there is less energy to take the form of latent heat, and the fuel in the line between the venturi pump 18 and the high pressure pump 22 is maintained at a higher pressure than the low pressure supply pressure.

Figure 2:
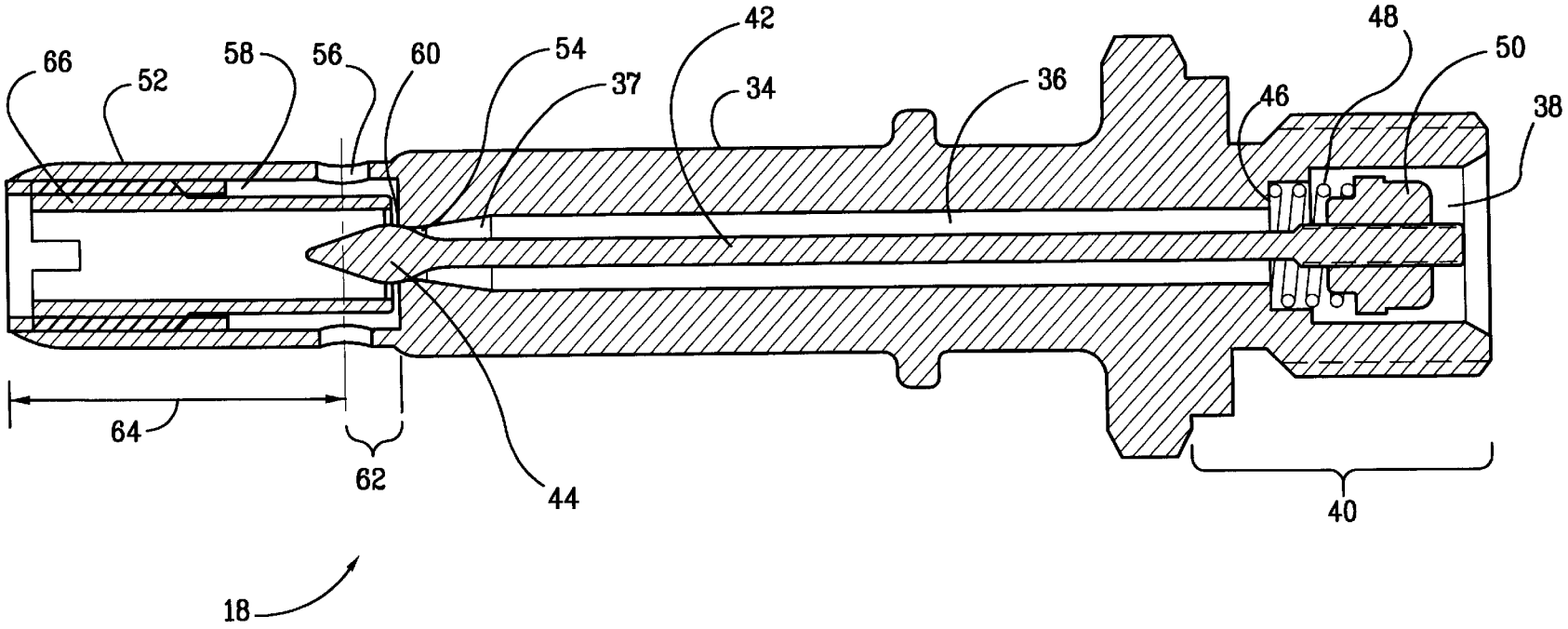
FIG. 2 is a cross-section of the variable orifice venturi pump according to the invention.
Figure 3:
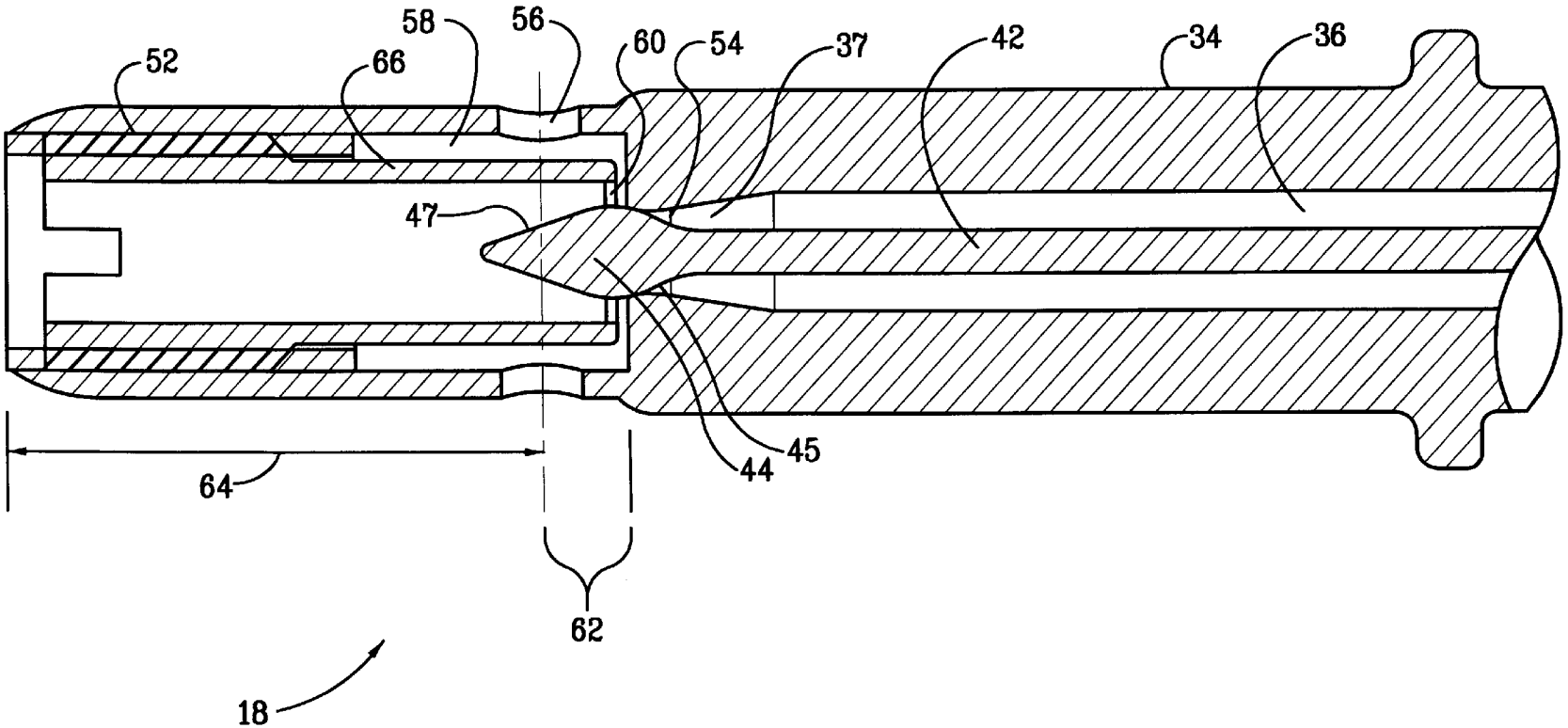
FIG. 3 is an enlarged partial cross-section of the pump of FIG. 2.

As shown in FIGS. 2 and 3, the venturi pump 18 includes a housing 34 that defines a passageway 36 therethrough for flow of return fuel 32 (See FIG. 1) from the fuel rail 24. The passageway 36 includes a converging section 37 at a downstream end thereof. The return fuel 32 enters the venturi pump 18 at inlet 38. The venturi pump 18 may be attached directly to the fuel rail 24 with a high-pressure seal (DIN 3852) 40. A spring-loaded valve 42 is disposed in the passageway 36. The spring-loaded valve 42 includes a downstream end 44 having a diverging portion 45 and a converging portion 47 (See FIG. 3). The housing 34 defines a stop 46 for receiving one end of the spring 48. The valve 42 includes a retainer 50 for receiving the other end of the spring 48. The retainer 50 may be threaded onto the valve 42 so that the spring tension of the spring 48 may be adjusted by compressing or releasing the spring 48 using the retainer 50.

As best seen in FIG. 3, a chamber 52 is disposed downstream of the passageway 36. The chamber 52 is fluidly connected to the passageway 36 by a return fuel nozzle 54. The varying pressure of the return fuel 32 on the downstream end 44 of the valve 42 causes the valve 42 to move in the passageway 36. The movement of the end 44 of the valve 42 into and out of the return fuel nozzle 54 creates a variably sized orifice.

The return fuel 32 makes a convergent flow path through the converging section 37 of the passageway 36. As the pressure of the return fuel 32 opens the valve 42 and moves it in the direction of the chamber 52, the return fuel 32 makes a divergent flow path downstream of the valve end 44.

Low-pressure supply fuel enters the venturi pump 18 through a second inlet 56, which empties, into an annular space 58. The annular space 58 empties radially into the chamber 52 by way of a supply fuel nozzle 60. The supply fuel nozzle 60 is disposed just downstream of the return fuel nozzle 54. The supply and return flows travel together in the mixing region 62. In the mixing region 62 the supply flow is accelerated and pressurized by the return flow. The return flow is decelerated and its pressure reduced. Downstream of the mixing region 62 is a diffusion region 64 where the flow is stabilized at a relatively low velocity to minimize pressure losses as the fuel flows to the inlet of the high-pressure pump 22.

The return fuel nozzle 54 maintains an elevated pressure between it and the high-pressure regulator 20. That elevated pressure is dependent on the force provided by the spring 48 and the return pressure to the high-pressure pump 22. Once the proper spring load is determined, it need not be adjusted. However, the retainer 50 may be threaded onto the valve 42 so that the spring tension of the spring 48 may be adjusted by compressing or releasing the spring 48 using the retainer 50.

The venturi pump 18 with the spring-loaded valve 42 creates a variable orifice where the end 44 of the valve varies the size of the return fuel nozzle 54. The variable orifice will close as the amount of return fuel is reduced. The high-pressure pump 22 is sized such that there will not be zero return flow. However, assuming that zero return flow could occur, the valve 42 will be closed and all the flow to the high pressure pump 22 would be supplied by the low pressure fuel supply 10. In this condition, the flow resistance of the venturi pump 18 will decrease supply pressure, but the fuel will be coming directly from the fuel tank 12 and will not have a vapor suppression problem.

The supply fuel nozzle 60 includes an adjustable sleeve flow director 66, which is adjusted to minimize the flow losses. The amount of adjustment may vary from, for example, about 0.5 to 1 millimeter. The flow director 66 may be threaded or interference fit.

Figure 4:
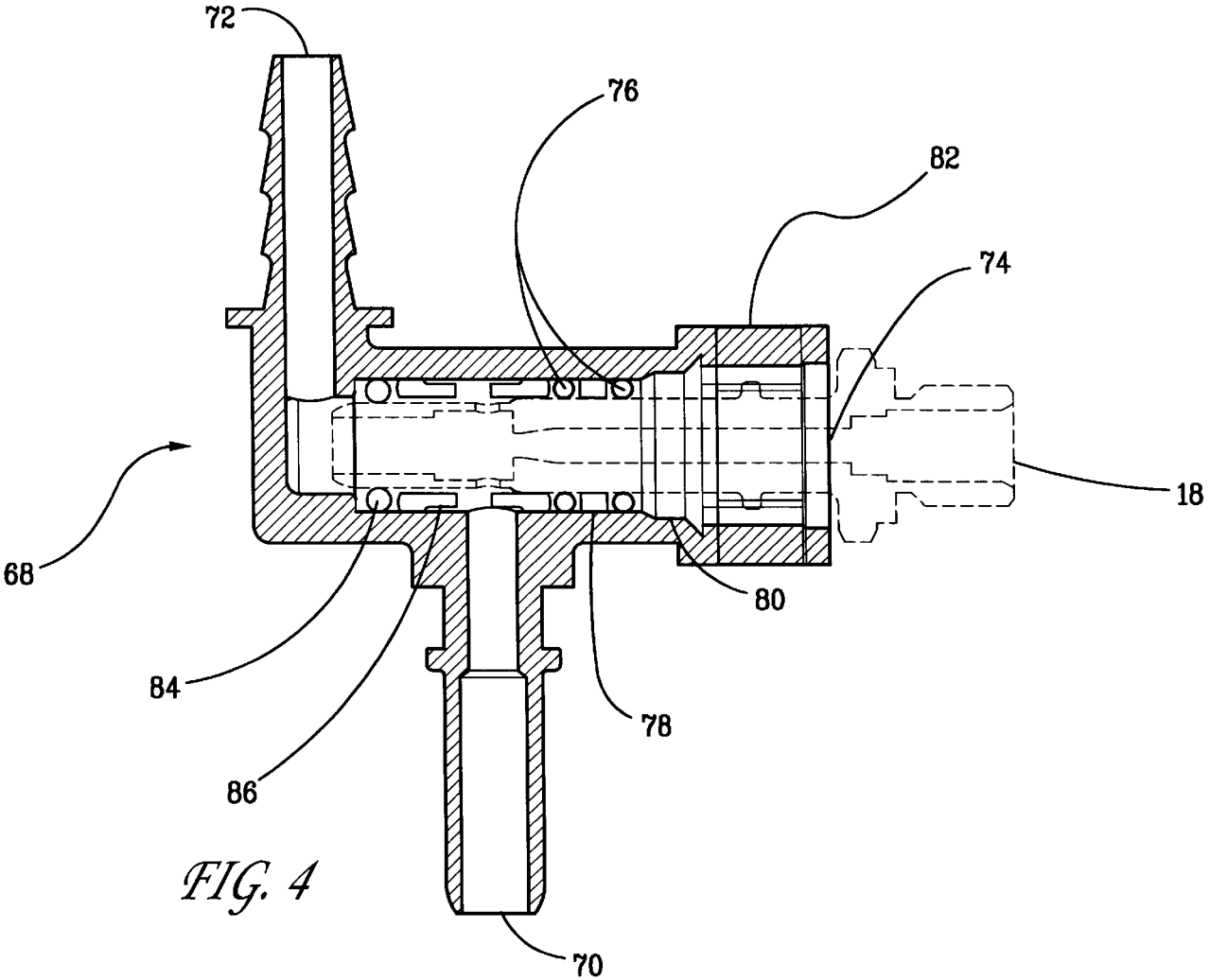
FIG. 4 is a cross-section of a quick connector according to the invention.

FIG. 4 shows a cross-section of a quick connector 68 into which the downstream end of the venturi pump 18 is inserted. The quick connector 68 includes a male quick connector 70 for the low-pressure fuel supply and a return line hose barb 72 to the high-pressure pump 22. The venturi pump 18 is inserted into a female quick connector 74. An external seal comprises two O-rings 76 separated by a spacer 78 followed by a back-up ring 80. A latching clip 82 secures the quick connector 68 to the venturi pump 18. An internal seal is provided by an O-ring 84, which seals the low-pressure supply fuel from the flow returning to the high-pressure pump 22. Also included is an internal spacer 86 between the internal seal O-ring 84 and the external seal O-rings 76.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A high pressure direct injection fuel system comprising:

a low pressure fuel supply;

a venturi pump including a variable orifice, first and second inlets and an outlet, the low pressure fuel supply connected to the first inlet of the venturi pump;

a high-pressure pump connected to the outlet of the venturi pump;

a fuel rail connected to an outlet of the high pressure pump, the fuel rail including at least one fuel injector and a pressure sensor;

a high-pressure regulator connected to the fuel rail, the high-pressure regulator including a variable aperture;

a return flow line connected between the fuel rail and the second inlet of the venturi pump; and an electronic control unit connected to the pressure sensor and the high-pressure regulator.

2. The system of claim 1 wherein the low-pressure fuel supply comprises a fuel tank, a low-pressure fuel pump and a low-pressure regulator.

3. The system of claim 1 wherein the venturi pump comprises a housing defining a passageway therethrough for flow of return fuel, a chamber downstream of the passageway for mixing of the return fuel and low pressure supply fuel, and a spring loaded valve disposed in the passageway.

4. The system of claim 3 wherein the spring-loaded valve includes a downstream end having a diverging portion and a converging portion.

5. The system of claim 4 wherein the variable orifice connects the passageway to the chamber and a size of the variable orifice is variable depending on the position of the downstream end of the spring loaded valve.

6. The system of claim 3 wherein the housing defines a stop for receiving one end of a spring that loads the spring loaded valve and the spring-loaded valve includes a retainer for receiving the other end of the spring.

7. The system of claim 5 wherein the first inlet of the venturi pump includes an annular region fluidly connected to the chamber downstream of the variable orifice.

8. The system of claim 1 further comprising a quick connector into which a downstream end of the venturi pump is inserted.

9. The system of claim 3 wherein a downstream end of the passageway includes a converging section.

10. A method of recirculating fuel in a high pressure direct injection system comprising:

controllably releasing high-pressure fuel from a fuel rail into a venturi pump with a high-pressure regulator, the high-pressure regulator including a variable aperture, the venturi pump including a variable orifice;

varying the size of a variable orifice in the venturi pump depending on a pressure of the high pressure fuel released from the fuel rail;

mixing the high pressure fuel with the low pressure fuel to create an intermediate pressure fuel with a pressure between a pressure of the high pressure fuel and a pressure of the low pressure fuel; and supplying the intermediate pressure fuel to a high pressure pump.

11. The method of claim 10 further comprising the step of sensing a pressure in the fuel rail.

12. The method of claim 11 wherein the step of controllably releasing high-pressure fuel from the fuel rail into the venturi pump further comprises controllably releasing the high-pressure fuel depending on the pressure sensed in the sensing step.

13. The method of claim 10 wherein the step of varying the size of a variable orifice in the venturi pump further comprises movement of a spring loaded valve having a downstream end with diverging and converging portions.

* * * * *